United States Patent [19]

Herrnring

[11] Patent Number: 4,708,506

[45] Date of Patent: Nov. 24, 1987

[54] INK SUPPLY SYSTEM WITH TUBE PUMP

[75] Inventor: Günther Herrnring, Alvesloe, Fed. Rep. of Germany

[73] Assignee: Montblanc-Simplo GmbH, Hamburg, Fed. Rep. of Germany

[21] Appl. No.: 905,878

[22] Filed: Sep. 10, 1986

Related U.S. Application Data

[62] Division of Ser. No. 620,162, Jun. 13, 1984, Pat. No. 4,634,305.

[30] Foreign Application Priority Data

Jun. 13, 1983 [DE] Fed. Rep. of Germany ..... 3321301

[51] Int. Cl.[4] ..... B43K 5/06; B43K 5/08; B43K 5/18

[52] U.S. Cl. ..... 401/151; 401/145; 401/149; 401/194; 401/230

[58] Field of Search ..... 401/145, 151, 149, 146, 401/230, 194

[56] References Cited

U.S. PATENT DOCUMENTS 4,350,458 9/1982 Murahara et al. ..... 401/145
4,634,305 1/1987 Herrnring ..... 401/151

*Primary Examiner*—Steven A. Bratlie
*Attorney, Agent, or Firm*—Becker & Becker, Inc.

[57] ABSTRACT

An ink supply system for writing instruments which operate with liquid ink. The writing instrument has a large-volume ink reservoir which communicates via a recharge valve with a small-volume ink reservoir which is adjacent to the writing element. The transmission of ink from the large-volume ink reservoir to the secondary reservoir is controlled by a sensor as a function of the quantity of ink which is present in the secondary ink reservoir. In order to simplify the recharging of the ink, and to be able to operate with the least possible electrical energy, the present invention utilizes as a recharge valve a tube pump which is rotatably driven by an electric motor and also can generate the pressure necessary to convey the ink to the secondary ink reservoir.

5 Claims, 12 Drawing Figures

INK SUPPLY SYSTEM WITH TUBE PUMP

This is a divisional application based on copending parent application of U.S. Ser. No. 620,162-Herrnring filed June 13, 1984 now U.S. Pat. No. 4,634,305.

BACKGROUND OF THE INVENTION

1. Field of the Invention

The present invention relates to an ink supply system for writing instruments which operate with liquid ink. The housing of the writing instrument, for the writing liquid, has a primary, large-volume reservoir which is preferably under excess pressure, and a secondary, small-volume reservoir which communicates with the outside air and with the writing element; the primary and secondary reservoirs are connected via a recharging valve which can be controlled as a function of need.

2. Description of the Prior Art

Ink supply systems of the aforementioned general type, which conform to a non-published proposal of the assignee of the present invention, exclusively utilize primary ink reservoirs which are at excess pressure. The recharge valve is then a true through-way valve which can be controlled for opening and closing. To the extent that this recharge valve is to be electrically rather than manually operated, and is preferably to be controlled via a sensor which takes advantage of impedance, an electrical power is required which in most cases cannot be furnished by a dry-cell battery accommodated in the housing of the writing instrument.

An object of the present invention therefore is to provide an improved recharge valve for ink supply systems of the aforementioned general type, which valve can be actuated with considerably less electrical energy and can operate without electromagnets, which practically operate in an abrupt manner.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1A:
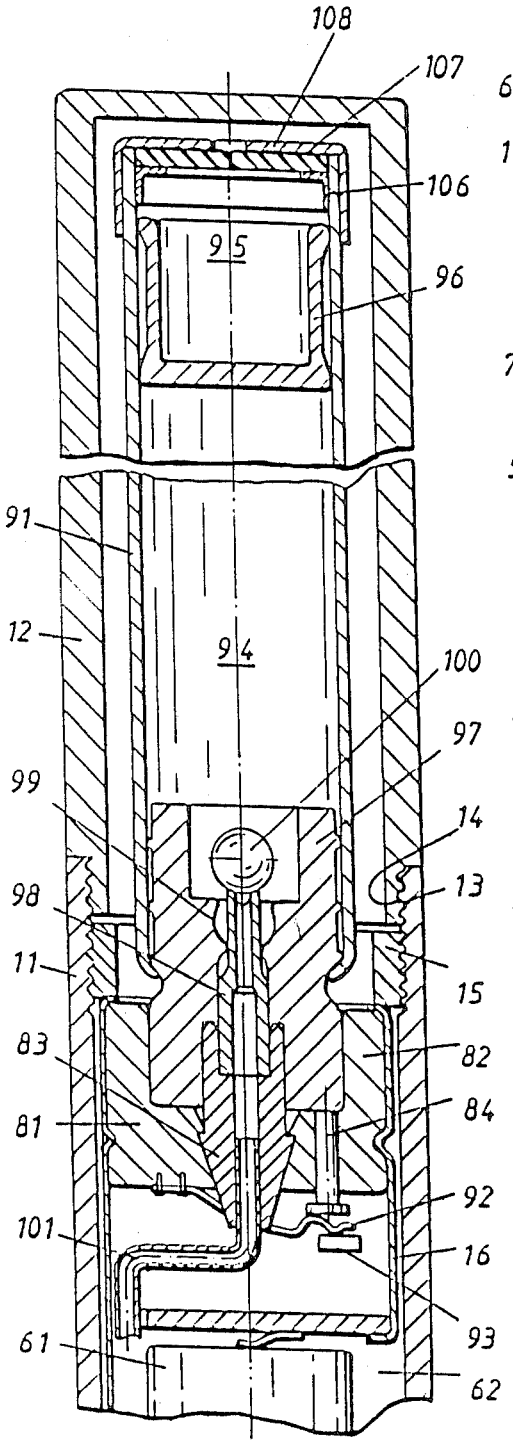
FIGS. 1*a* and 1*b* show, when vertically disposed, the top and bottom portions respectively, in vertical section, one embodiment of the inventive writing instrument.

The ink supply system of the present invention is characterized primarily in that the recharge valve is in the form of a tube pump.

An electric motor drive of the tube pump can be operated with less electrical power since the electrical work extends over a greater period of time. This electrical power then very easily can be furnished by an electrical dry-cell battery located in the housing of the writing element. The use of the tube pump has the further advantage that with it the pressure can be established which conveys the ink from the primary reservoir to the secondary reservoir. In other words, the inventive ink supply system also is able to operate when the primary ink reservoir is not at excess pressure. In this case, the primary ink reservoir is essentially at atmospheric pressure.

A spring mechanism motor can be provided as the drive for the tube pump. For this purpose, within the housing of the writing instrument, an electric motor, which is supplied from a battery, can be provided.

To control the tube pump drive, a sensor can be provided with monitors the filling of the secondary reservoir. The large-volume ink reservoir may be in the form of a replaceable ink cartridge, and in the seat for the cartridge in the housing of the instrument, there may be provided a spring contact arrangement which turns off the battery when there is no cartridge in the seat.

Pursuant to a first inventive embodiment, the tube pump comprises a radial ball bearing which is eccentrically connected with the shaft of the electric motor and which has its outer bearing ring contacting a tube portion which is supported on an annular wall which extends concentric to the motor shaft. In such a case, control means must, of course, be provided in order to assure that when the tube pump is not operating it does not remain in a position in which the connection between the primary and secondary ink reservoirs is not closed off.

The last-mentioned control means can be eliminated if, pursuant to a preferred embodiment, a peristaltically operating tube pump having a tube which essentially extends in the axial direction of the housing of the writing instrument is utilized. This tube pump has at least three successively connected chambers in which, with radially moved pistons, those tube sections located in the chambers are successively and periodically squeezed together. In this case, the supply line connection between the primary and secondary ink reservoirs is shut off in at least one of the three chambers.

The radially moved pistons are non-rotatably arranged, and are moved radially back and forth by means of eccentric curved guides which are disposed on both sides of the pistons and are rotatably driven by the motor. The pistons, which may be radially moved by the eccentric, may operate against a flat carrier upon which the preferably flat pump tube is supported. That side of the flat tube which is remote from the flat carrier may be provided with an integrally molded-on fin which is clamped in the radially moved pistons. On that side supported upon the flat carrier, the flat tube may be provided with integrally molded-on anchoring extensions which are securely and positively inserted into the carrier.

DESCRIPTION OF PREFERRED EMBODIMENTS

Figure 1B:
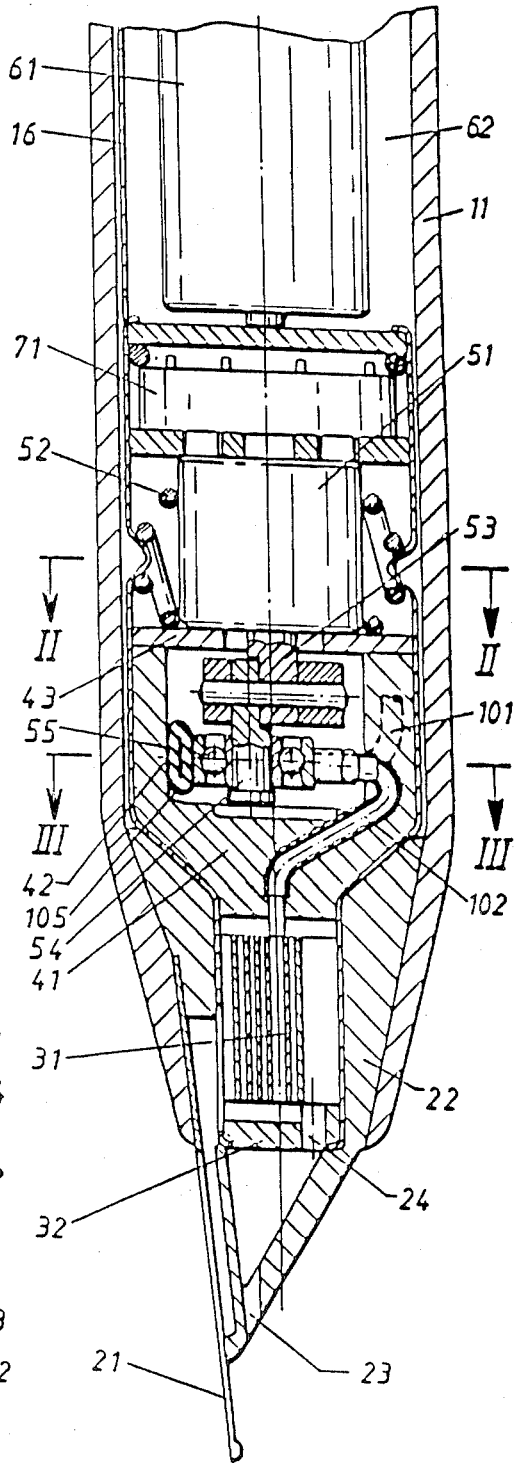

Referring now to the drawings in detail, the writing instrument is illustrated collectively via split views that show top and bottom portions respectively in FIGS. 1*a* and 1*b*. The writing instrument operates with liquid ink and utilizes, as the writing element, a nib, although a ballpoint, a writing tube, or a felt tip could just as easily be used as the writing element therewith. This writing element, which is in the form of a fountain pen, comprises the following principal components:

The bottom portion of the housing 11, the top portion of the housing 12, the writing element 21 in the form of a nib, the secondary, small-volume ink reservoir 31 which communicates with the outside air and with the writing element 21, the tube pump 41 which supplies the reservoir 31, the electric motor 51 which actuates the tube pump 41, the dry-cell battery 61 which supplies the electric motor 51, the electronic control 71, the seat 81 for the ink cartridge, and the ink cartridge 91, which comprises the primary, large-volume reservoir which is preferably at a pressure in excess of atmospheric pressure. Not shown in the drawings is the customary cap for the writing element 21.

The two housing parts 11 and 12 are connected with one another via screw threads 13, 14. Separation of the two housing parts 11 and 12 facilitates manufacture of the writing instrument, and above all also serves for or facilitates replacement of the dry-cell battery 61 and the ink cartridge 91 when these are used up. The excessively long female thread 14 on the bottom portion of the housing 11 also serves to receive a screw ring 15 with which a casing 16 can be secured in the bottom portion of the housing 11. This casing 16, which is provided with a sheet-metal shell, connects the secondary ink reservoir 31, the tube pump 41, the electric motor 51, the electronic control 71, the chamber for receiving the dry-cell battery, and the seat 81 for the cartridge into an assembly in which also are located the ink supply lines 101 and 102. The line 101 leads from the seat 81 for the ink cartridge to the tube pump 41, and the line 102 leads from the tube pump 41 to the secondary ink reservoir 31. Obviously, when the screw connection 13/14 is opened and the screw ring 15 is turned out, the entire casing 16 can be withdrawn from the bottom portion of the housing 11 of the writing instrument. Since the casing 16 has no sidewall in the vicinity of the chamber 62, the dry-cell battery 61 can be replaced above this missing sidewall. The casing 16, which is preferably made of conducive sheet metal, eliminates the need for electrical connecting lines which would be necessary in order to connect the dry-cell battery 61 with the electronic control 71, which is in the form of a plate bar, with the electric motor 51 and with the sensor 32 which is disposed in the vicinity of the secondary ink reservoir 31.

Every time that the sensor 32, which is preferably capacitive, detects that the ink supply in the reservoir 31 is running short, the electric motor 51 is turned on by means of the electronic control 71 via a signal coming from the sensor 32. Thus, as will be subsequently described, the tube pump 41, which is disposed between the cartridge 91 and the secondary ink reservoir 31, starts up and the secondary ink reservoir 31 is refilled from the cartridge 91 until the sensor 32 again signals a sufficient filling, and the motor 51 is turned off again via the control 71. In particular, this takes place in such a way that the connecting lines 101 and 102 between the two ink reservoirs are separated from one another. The active circuit of the sensor registers, for example, the impedance fluctuations and signals them in varying intervals in the form of voltage pulses. The time between the individual pulses is inversely proportional to the measured state of filling. These signals, which are coded by the pulse intervals, are more trouble-free than voltage modulated or frequency modulated signals for the control of the stepping motor which actuates the pump.

Within the bottom portion of the housing 11 there is located a housing insert 22 which serves to secure the pen nib 21, to receive the casing 16, to form the ink conductor for the nib 21, and also contains a vent opening 23 which makes possible a venting of the capillary system via the further opening 24 which is disposed at the secondary reservoir 31. The ink conductor for the nib 21 has an ink channel which continues into the capillary reservoir 31 through a gap in the casing 16.

Figure 3:
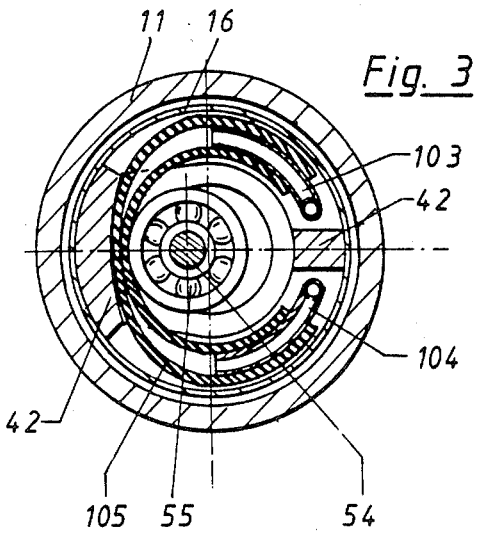
FIG. 3 is a cross-sectional view taken along the line III—III in FIG. 1*b;*
Figure 4:
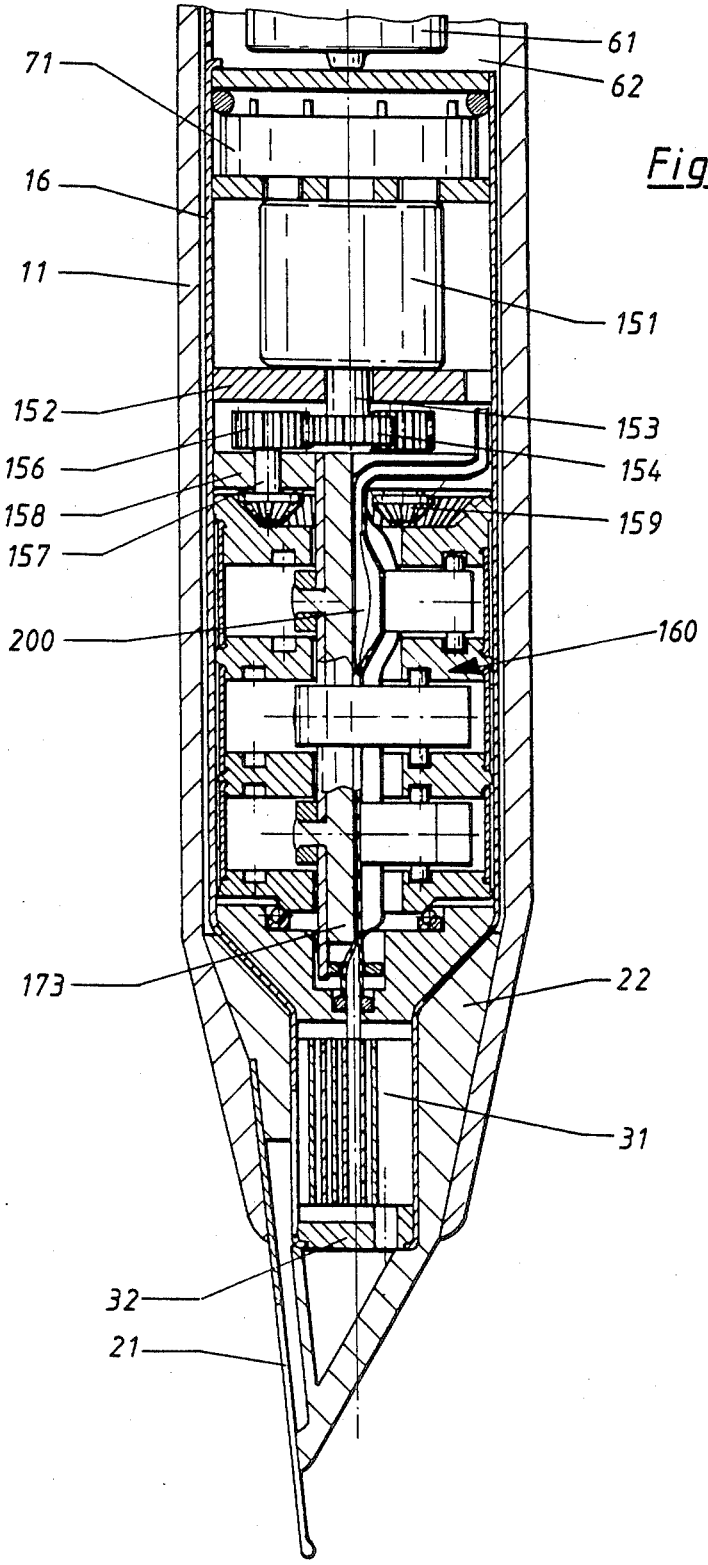
FIG. 4 is a view similar to that of FIG. 1*b* of a modified embodiment of an inventive writing element which has a peristaltically operating tube pump.

The tube pump 41, which is disposed within the casing 16, is surrounded by a cup-like housing 42, the interior of which is covered relative to the electric motor 51 by a partition 43 which is provided with an opening. The electric motor 51 is movably limited in the radial direction by means of a wire spring arrangement 52 which is laterally suspended on a wall of the casing 16 which is provided with an inwardly directed bead. The shaft 53 of the electric motor 51 projects through the middle of the partition 43 into the housing 42, where it supports an eccentric shaft 54, on which there is securely mounted the inner ring of a radial ball bearing 55. The outer ring of the ball bearing 55 rests against the pump tube 105, which is preferably a flat tube. Within the housing 42, the pump tube 105 extends approximately over an arc of 300°, and is placed upon metal tubes 103 and 104 (FIG. 3).

The metal tubes 103 and 104 either communicate with the aforementioned lines 101 and 102, or form parts thereof. The inner wall of the housing 42 is designed in such a way that the ball bearing 55, which is mounted on the eccentric shaft 54, squeezes the tube section 105 from one end to the other over an area of about 90°. As a result, the ink coming from the cartridge 91 is conveyed to the secondary ink reservoir 31. In order to prevent the tube pump from stopping in one position after being turned off via sensor control, for example in a position which is 180° out of phase from the position illustrated in FIG. 3, and in which there exists a free connection between the cartridge 91 and the ink reservoir 31, the electronic control 71 utilizes a further sensor which detects the position of the pump 41 and turns the latter off in such a way that the tube 105 is actually closed.

Since the tube pump 41 represents not only a valve but also a conveying element, the writing instrument of FIGS. 1*a* and 1*b* can be provided with an ink cartridge 91 which is free of pressure. This generally presupposes that the tube pump operates with a tube which has a circular cross section and which again assumes a hollow cylinder shape beyond the squeezing zone. However, a good closing-off of the tube when the pump is not being operated is generally better achieved with a flat tube which in the squeezed-together state forms no wedges at the edges through which ink can leak or trickle under unfavorable conditions, even when the tube is squeezed together. However, with a writing instrument pursuant to FIGS. 1*a* and 1*b*, the flat tube requires an ink cartridge 91 which is under pressure and which can raise the flat tube, i.e., can deform the tube to have a circular cross section.

FIGS. 4 to 10 show a writing instrument which is similar to the previously described embodiment, but is provided with a pump which operates with a flat tube. At any position of the pump arrangement, the connection between the primary and the secondary ink reservoir is closed off, and the pump can work either with an ink cartridge which is under pressure, or with an ink cartridge which is free of pressure.

As shown in FIG. 1*a*, the seat 81 for the ink cartridge is formed by a cup-like insert 82 of the casing 16. The ink supply line 101, via which the ink reservoir 94 of the cartridge 91 is connected to the tube pump 41, is connected to the bottom of the insert 82 by means of a conical stopper 83. A bore in the bottom of the insert 82 contains a pin 84 which cooperates with a spring contact switch 92. When no cartridge is located in the recess of the insert 82, the spring contact 92 pushes the pin 84 upwardly, so that it does not come into contact with the counter or opposite contact 93, which is constantly connected with the contact 92 when a cartridge is inserted. When no ink cartridge 91 is present, the contact arrangement 92/93 switches off the battery 61 in order to increase the life expectancy thereof.

The interior of the ink cartridge 91 is divided, by means of a freely moving piston 96, into the actual ink reservoir 94 and a gas pressure chamber 95. In this case, the gas pressure chamber 95 is closed off by a welded-shut cap 108, a gasket 107, and and gasket-supporting ring 106. When the ink cartridge is made free of pressure, the piston 96, or a soft follower float, follows the ink; the closure cap 108 contains a central opening, and the gasket 107 is provided with a slit, so that a pressure equalization to the atmosphere takes place an no partial pressure can form in the chamber 95. The piston 96 prevents a mixing of the pressurized gas in the ink. By means of a rolled-in portion, a plug 97 is disposed at the bottom open end of the cartridge 91. The plug 97 can extend tightly into the insert 82, and when inserted connects the ink reservoir 94 with the ink supply line 101 via a tube 98. Within the plug 97 there is provided a check valve having a closing ball 100 which normally is located in a valve seat 99 of the plug 97 and keeps the cartridge 91 closed under the effect of the excess pressure therein. As can be seen in FIG. 1*a*, when the cartridge 91 is placed into the valve seat, the tube 98 is pushed in so as to push the ball 100 out of the valve seat 99, so that a free connection is possible between the ink reservoir 94 and the ink supply line 101. If after loosening the screw connection 13/14, the ink cartridge 91 is removed from its seat 81, the tube 98, driven by the closing ball 100, and due to the excess pressure, can be moved back until the ball 100 again reaches its valve seat 99 and the cartridge 91 is hermetically sealed. When the cartridge 91 is removed, the contact arrangement 92/93 is again interrupted, as described above.

Figure 2:
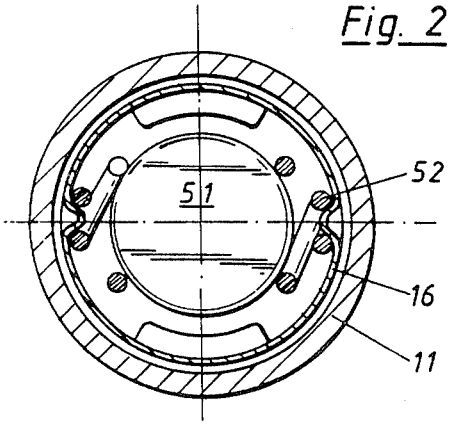
FIG. 2 is a cross-sectional view taken along the line II—II in FIG. 1*b;*

With the previously referred-to embodiment of FIGS. 4 to 9, those components which correspond to components of the writing instrument of FIGS. 1 to 3 are provided with the same reference numerals.

In this embodiment, there also is located in the bottom portion of the housing 11 of the writing instrument an insert 22 which serves to receive a casing 16 in which is located the chamber 62 for the dry-cell battery 61, the electrical control 71 in the form of a plate bar, the capillary secondary ink reservoir 31 with the sensor 32, and the tube pump 160, with the drive thereof, which will be described subsequently in greater detail.

Figure 5:
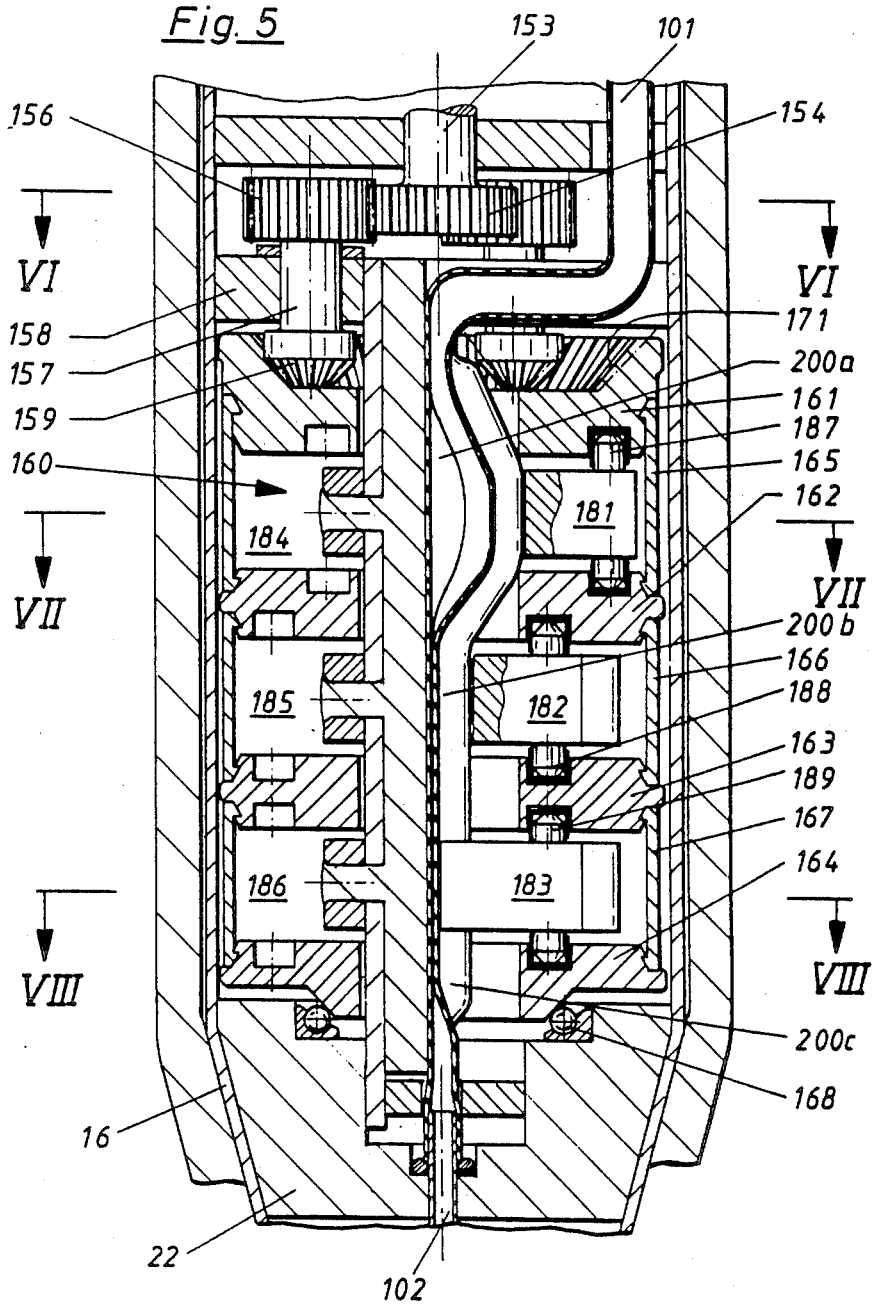
FIG. 5 shows a portion of the writing instrument of FIG. 4 but to an enlarged scale.
Figure 6:
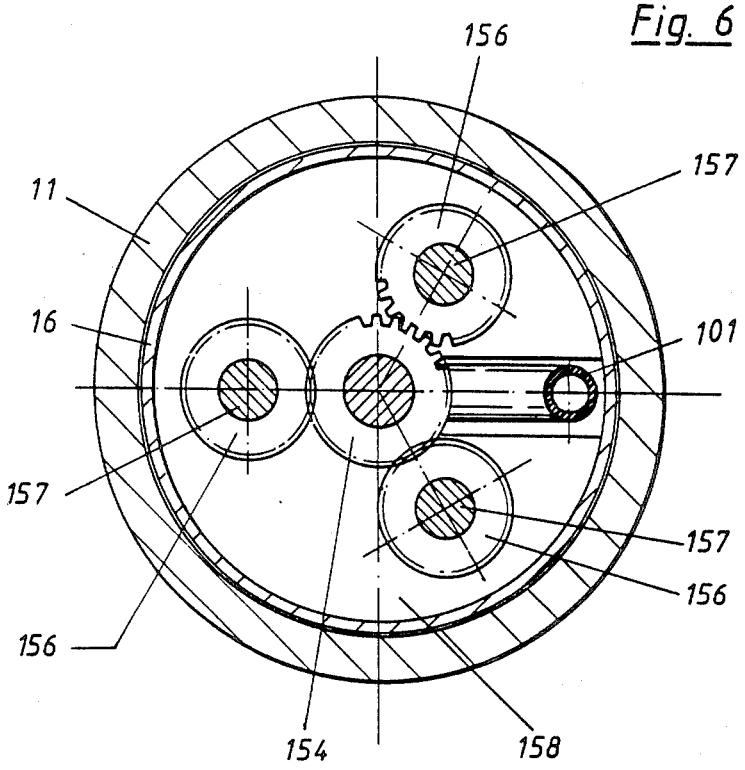
FIG. 6 is a cross-sectional view taken along the line VI—VI in FIG. 5.

An electric motor 151 supported on a partition 152 in the casing 16 again serves for the drive. The drive shaft 153 of the electric motor 151 passes through the central opening of the partition 152, and at the free end thereof supports a driving pinion 154. The driving pinion 154 meshes with free equidistantly arranged gears 156 on short shafts 157. As can be seen in FIG. 5, the short shafts 157 are mounted in a further partition 158 of the casing 16. On those ends remote from the gears 156, the shafts 157 carry bevel gears 159 with which the pump rotor is driven in a manner which will be described subsequently. Fundamentally, the central driving pinion 154 alone could drive the pump rotor; however, it is more expedient, with regard to the tolerances which otherwise would have to be extremely precise, to support and drive the rotor at three locations distributed about the periphery.

Figure 11:
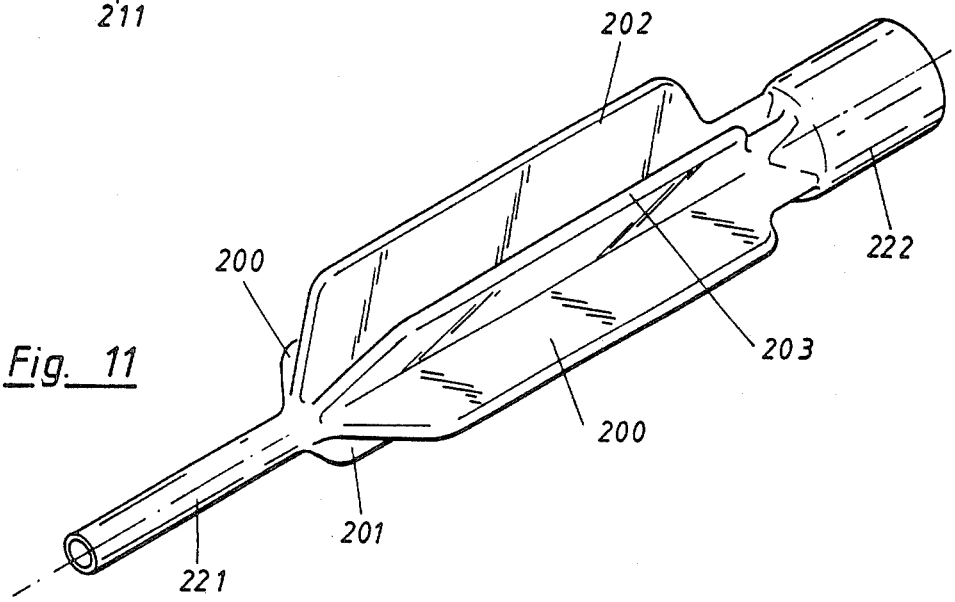
FIG. 11 shows the pump tube produced from the mold body of FIG. 10.

The pump unit 160 itself is disposed in the casing 16 between the partition 158 and the conical insert 22 above the capillary ink reservoir 31. The ink feed is the ink supply line 101 which comes from the ink cartridge 91. The discharge from the pump to the capillary ink reservoir 31 is effected via the ink supply line 102 which is anchored in the insert 22. A flat tube 200 illustrated in FIG. 11 is located between these two ink supply lines 101 and 102. The cross section of the tube 200 in the open and closed state is particularly clear in the sectional views of FIGS. 7 and 8. Since a flat tube cannot adapt or put itself into an open duct or passage-through position, certain provisions must be made, to the extent that a cartridge free of pressure is used as the primary ink supply, in order to move the flat tube from the position illustrated in FIG. 8 into the position of FIG. 7. For this purpose, the flat tube is provided with three radially directed fins, with the two lower fins 202 and 203 serving for anchoring, and the upper fin 201 serving, in a manner which will subsequently be described, as an actuating element which a clamp can engage in order to open the central portion of the flat tube.

Figure 10:
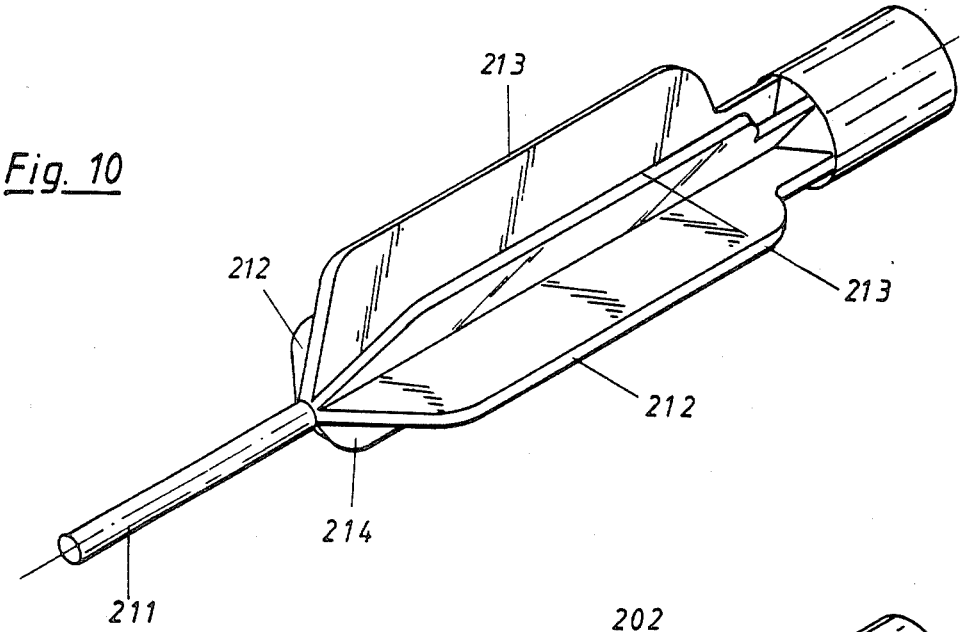
FIG. 10 is a perspective view of a mold body for producing the pump tube illustrated in FIG. 11.

A particularly advantageous fabrication of the tube pursuant to FIG. 11 is possible in the dipping process with the aid of the core illustrated in FIG. 10. The left end of the solid core as illustrated in FIG. 10 is provided with a cylindrical rod-shaped extension 211 which during the molding process forms a thin tube 221 that can be sealingly connected to the ink supply line 102. Two of the centrally disposed ribs 212 together form the central portion of the flat tube 200. The two ribs 213 disposed between the ribs 212 of the mold body of FIG. 10 form the two anchoring fins 202, 203, which, due to the method of manufacture, have two layers. The remaining lower rib 214 forms the actuating fin 201. The tube end 222 shown at the right in FIG. 11 serves for connection to the ink supply line 101. After immersion of the mold body of FIG. 10 in appropriate tube forming material, and vulcanization, the thin tube formed on the mold body can be removed in order to then be placed in the pump of FIG. 5 in the shape shown in FIG. 11.

The tube pump 160 itself comprises a stator and a rotor. The stator includes the flat path tube carrier 173 which is anchored between the insert 22 and the partition 158. This tube carrier 173 cooperates with the abutments 175, which have a U-shaped cross section, in order to clamp in the outer ends of the flat hose fins 202 and 203, and to hold the middle portion of the flat tube in a precisely defined position on the flat upper side of the tube carrier 173.

Figure 7:
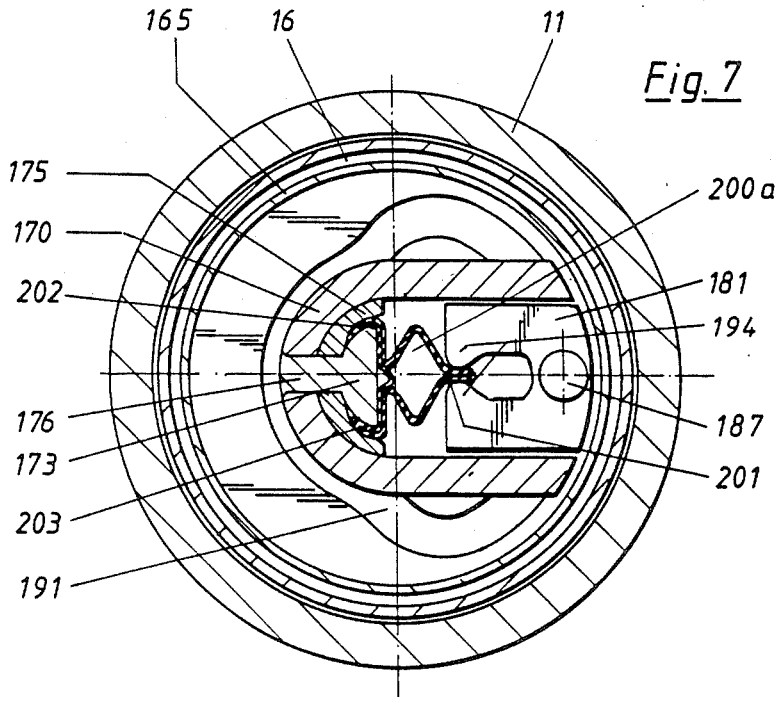
FIG. 7 is a cross-sectional view taken along the line VII—VII in FIG. 5.
Figure 8:
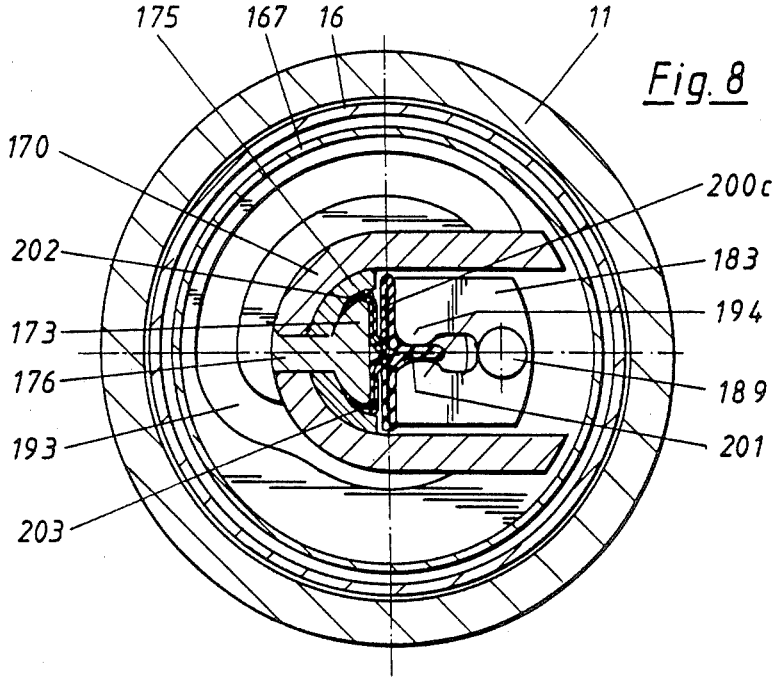
FIG. 8 is a cross-sectional view taken along the line VIII—VIII in FIG. 5.

As shown in FIG. 5 in conjunction with FIGS. 7 and 8, the clamping force between the components 173 and 175 is achieved by riveting or welding pin-like extensions 176 of the carrier 173 in U-shaped piston guides 170.

The pump rotor itself comprises four eccentric guide disks 161–164, which with the aid of interposed tubular sections 165, 166, and 167 are joined to form a drum rotor. Between each two of the eccentric guide disks 161–164, in the vicinity of the tubular sections 165–167, are located three pump chambers 184, 185, and 186 in which are disposed the sections a, b, and c of the pump tube 200. In each of these pump chambers 184–186 are found the aforementioned U-shaped piston guides 170, in which are disposed the three pistons 181, 182, and 183. The piston 181 is provided on opposite sides with coaxially aligned guide pins 187 which face the guide disks 161 and 162. In a similar manner, two coaxially aligned guide pins 188 are disposed on the piston 182, and two coaxially aligned guide pins 189 are disposed on the piston 183.

Figure 9:
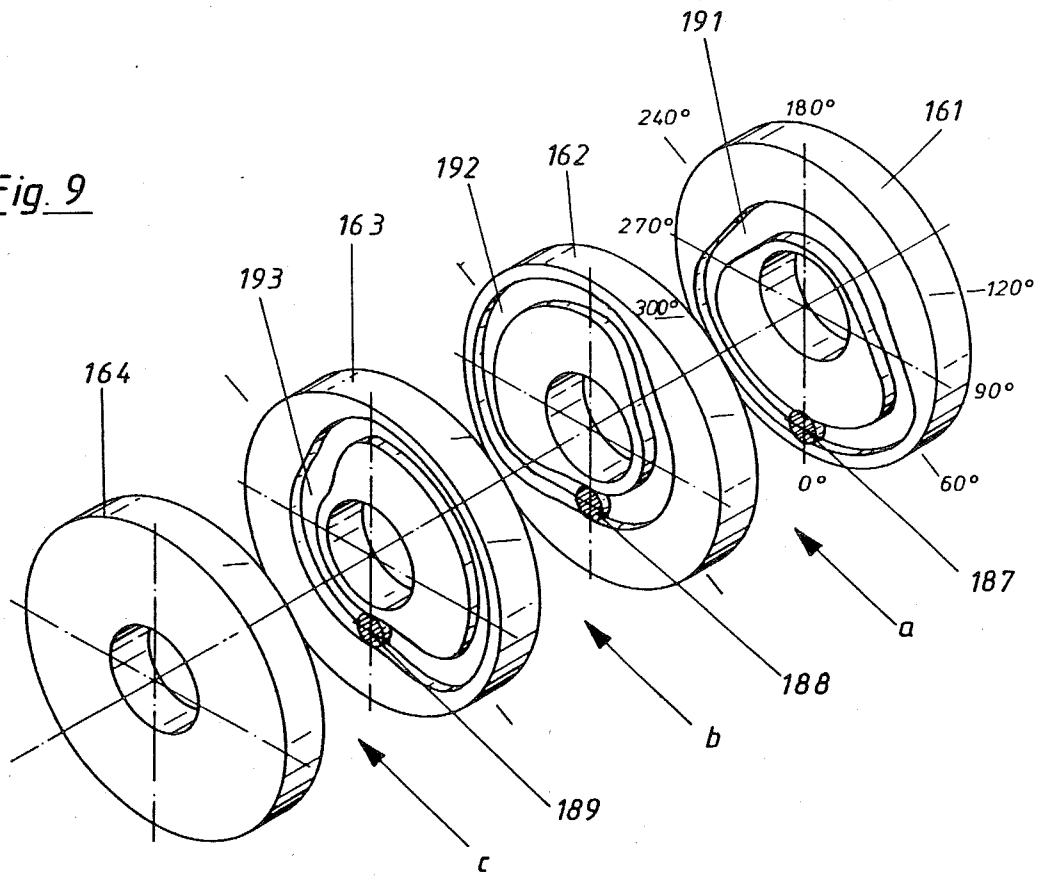
FIG. 9 is a spread-apart perspective schematic illustration of the eccentric guides provided in the pump of FIGS. 4 and 5.

As shown in FIG. 9, the pairs of guide pins 187–189 extend into guide grooves of the eccentric disks, which grooves are symmetrical.

The aforementioned pump rotor, which is formed from the components 161 to 167, is driven with the aid of the bevel gears 159, which mesh in an internally toothed bevel gear 171 formed in the outside of the eccentric guide disk 161. The three bevel gears 159 provide for coaxial alignment. A taper-roller or conical-roller bearing 168 serves as the outer support and is disposed on the inside of the housing insert 22. The balls or rollers of the bearing are supported on a race provided on the outside of the eccentric guide disk 164.

Since the pistons 181–183 are fixed in the radial direction in the U-shaped piston guide 170, as the pump rotor 161–167 rotates, the pistons are moved back and forth in the radial direction by the guide grooves 191, 192, and 193 (FIG. 9) provided on the guide disks 161–164. With these radial movements of the pistons 181–183, the flat tube 200 (FIGS. 7 and 8) is successively and in sections pulled apart in the radial direction and hence opened, since the tube fin 201 is clamped between pairs of jaws 194 of the pistons 181–183.

As shown in FIG. 9, the guide grooves 191–193 of the guide disks 161–164 are offset relative to one another by respectively 120°. Due to the arrangement of three consecutively connected pump chambers 184–186, the passage of the pump tube between the ink supply lines 101 and 102 must at all times be shut off at one or two locations. It makes no difference in what position the pump rotor stops when it is turned off as a result of sensor control and no longer runs. In all cases ink is peristaltically conveyed from the ink supply line 101 to the line 102. If less than three pump chambers are used, a sensor would have to be provided just as in the embodiment of FIGS. 1 to 3; this sensor would detect the operating position of the tube pump and would establish the shut off in such a way that the supply line for the ink is closed off. Although it is possible to have more than three pump chambers, no further advantages are achieved and the structural and manufacturing expenses are increased thereby.

The peristaltically operating tube pump of FIGS. 4 to 11, with the tube which essentially extends in the axial direction, of course can have a plurality of other applications which have nothing to do with writing instruments. Since at least three successively connected chambers are provided which are successively and periodically squeezed together, there is achieved the advantageous effect that, in any desired shut-off position, the flow of medium through the tube can be interrupted in the manner of a shut-off valve.

The present invention is, of course, in no way restricted to the specific disclosure of the specification and drawings, but also encompasses any modifications within the scope of the appended claims.

What I claim is:

1. An ink supply system for a writing instrument which operates with liquid ink; said system comprising:

a housing for said writing instrument, said housing including a primary large-volume reservoir for ink, and a secondary, small-volume reservoir;

a writing element connected to said housing; said secondary reservoir communicates with outside air and with said writing element;

a tube pump which acts as a recharge valve, is controllable as a function of need, and connects said large-volume reservoir to said small-volume reservoir;

which includes, as a drive mechanism for said tube pump, an electric motor in said housing; and which includes a battery in said housing for said electric motor;

which includes a sensor associated with said secondary reservoir for monitoring the content thereof, and for controlling said drive mechanism for effecting said control of said tube pump;

said large-volume reservoir being in the form of a replaceable ink cartridge; said housing including a seat for said cartridge, and associated with said seat, a spring contact arrangement for disconnecting said battery from said drive mechanism when no ink cartridge is provided on said seat;

said ink cartridge being essentially at atmospheric pressure, and the pressure necessary to convey ink from said cartridge to said secondary reservoir is produced by said tube pump;

said tube pump being a peristaltically-operating tube pump having a tube which essentially extends in the axial direction of said housing;

said tube pump being provided with at least three successively connected chambers, each of which includes a radially moved piston, and has a portion of said tube disposed therein; said pistons successively and periodically squeeze together said portions of said tube.

2. An ink supply system according to claim 1, in which said pistons are non-rotatably disposed in said chambers, and which includes, on opposite sides of each of said pistons, respectively eccentric curved guides which are rotatably driven by said electric motor and move said pistons radially back and forth.

3. An ink supply system according to claim 2, which includes a flat-surfaced carrier against which said pump tube is supported; said pistons operate against said carrier.

4. An ink supply system according to claim 3, in which said pump tube, on that side remote from said carrier, is provided with a fin which is clamped into said pistons.

5. An ink supply system according to claim 4, in which said pump tube, on that side which is supported on said carrier is provided with integrally formed-on anchoring extensions which are securely and positively inserted into said carrier.

* * * * *